US005110038A

United States Patent [19]

Pantisano et al.

[11] Patent Number: 5,110,038

[45] Date of Patent: May 5, 1992

[54] PLATE FORMING AND BREAK DOWN PIZZA BOX

[76] Inventors: Frank Pantisano, 411 Linda Ave.; Scott M. Devine, B7 Fairways Apartments, both of Blackwood, N.J. 08012

[21] Appl. No.: 685,926

[22] Filed: Apr. 16, 1991

[51] Int. Cl.[5] ..... B65D 5/54

[52] U.S. Cl. ..... 229/103; 206/551; 229/906; 426/115

[58] Field of Search ..... 229/8, 103, 902, 906; 206/602, 551; 426/111, 115

[56] References Cited

U.S. PATENT DOCUMENTS

| | | | |
|---|---|---|---|
| 916,986 | 4/1909 | Bopp . | |
| 3,335,846 | 8/1967 | Mills | 206/551 |
| 3,650,383 | 3/1972 | Nigro | 206/45.31 |
| 3,771,713 | 11/1973 | Davidson | 229/27 |
| 4,470,538 | 9/1984 | Heathcock et al. | 229/23 |
| 4,648,548 | 3/1987 | Shin | 229/8 |
| 4,804,137 | 2/1989 | Harby | 229/906 |
| 4,819,862 | 4/1989 | Maroszek | 229/125.27 |
| 5,014,853 | 5/1991 | Crockett | 206/602 |

FOREIGN PATENT DOCUMENTS

| | | | |
|---|---|---|---|
| 1047592 | 12/1953 | France | 229/8 |
| 406051 | 6/1966 | Switzerland | 229/8 |

*Primary Examiner*—Gary E. Elkins
*Attorney, Agent, or Firm*—Thomas A. Lennox

[57] ABSTRACT

A standard corrugated paper pizza box is provided with slit cuts cut through the top panel of the pizza box in a shape to form four circular serving plates with a beveled raised edge and cross slit cuts through the bottom panel of the pizza box separating the box into four essentially equal portions for easy disposal.

18 Claims, 3 Drawing Sheets

PLATE FORMING AND BREAK DOWN PIZZA BOX

BACKGROUND OF THE INVENTION

This invention involves a paper box, more particularly a corrugated paper box for take out and delivery of pizza pies. Specifically, portions of the box yield paper serving plates and an embodiment allows the box to be separated or at least easily bent into small sized disposable pieces.

The pizza pie has become one of the most popular dishes in this country. The common form is a square or round flat crust on which tomato sauce and cheese and/or other ingredients are placed before baking in a high temperature oven. A wide variety of toppings are provided sufficient to suit almost everyone's taste. Although a significant portion of the pizza is eaten in the restaurant or parlor a good portion is ordered and taken out to eat at home, at picnics or at parties. Various types of packaging has been used, but most pizza parlors utilize a cardboard box sized to hold twelve, fourteen, or sixteen inch pies. Although octagonal and hexagonal boxes are offered, the most common is a box with a square top and bottom. Recently, the boxes are constructed of corrugated cardboard for added rigidity and insulation.

These corrugated cardboard boxes are not easy to discard. It is difficult to fold the box up into a small package that will readily fit into a kitchen trash can. When the standard corrugated pizza box is placed in a large trash can, it typically spans the entire inside diameter and is wedged side to side substantially reducing the effective capacity of the trash can. Commonly, cardboard and corrugated boxes are the subject of recycling programs generally requiring that the cardboard boxes be broken down, flattened and packaged in a relatively small cross-sectional area. The corrugated pizza box resists these disposal methods.

As suggested above, pizza pies are popular as a quick and easy lunch or dinner. Generally, pie is eaten in an extremely informal manner, such as in front of the TV set, at a party gathering, or even outside at a picnic, a ball game, or like setting. On those occasions, it is usually not desirable to furnish plates and table utensils, as one of the purposes of a "quick meal" is to reduce clean up time and effort. Further, many persons do not utilize table utensils in consuming the pizza. A most common technique is to simply pick up the slice of pizza by the crust folding the edges upwardly and eating it directly out of the hand. On the other hand, there are many situations where the host or hostess would like to serve the slices to the individuals and, when the pizza is very hot, it is very helpful to have something to rest the slice of pizza on while waiting for it to cool and then eating it. Use of separate paper or plastic plates is an added expense and substantially increases the amount of trash generated during the serving and consuming a pizza pie.

None of the containers and boxes of the prior art have satisfied the above needs nor have they attained the objects described herein below.

SUMMARY OF THE INVENTION

It is an object of the present invention to provide a pizza pie box that can be easily broken down into small portions, which are easy to discard or package to comply with recycling regulations.

It is an additional object of the present invention to provide a pizza pie box that allows serving plates to be punched out or torn out of the panels of the box.

It is a particular object of the present invention to provide perforations cut through the top panel of the pizza box wherein the line of the perforations forms a plurality of serving plates.

It is particularly preferred that the perforations forming the serving dishes approach and be asymptotic to the edges of the top panel and to each other, such that when the plates are removed, essentially all of the top panel is removed leaving only the flaps to be folded up and discarded.

It is an additional object of the present invention to provide perforations bisecting a second box panel not being used for plates such that second panel can also be broken up or torn into small portions for easy disposal.

It is an additional object to provide a non-porous surface on the inside of the panel or panels of the box which contain the perforations to form the serving plates.

Throughout the specification and claims, a line of slit cuts are described as being cut through the panel material around the periphery of the removable plates or to bisect the panel to merely facilitate disposal. The term "perforations" is used to describe these cuts. That term is sometimes used elsewhereto describe such cuts, but with the removal of material, such as the perforations in postage stamps. The use of that word is not intended to limit the scope of the invention particularly when a roulette cut is preferred. The term "roulette" is not a commonly used word although it is used in the trade derived from the roulette wheel used by engravers to cut a line of interrupted slits through the material. The cuts utilized in the present invention may be formed by either a roulette cut or by perforations and it is only necessary that the cut be sufficient that the panel generally hold together as a package, but that upon directed force readily allow removal of the plate shape from the box panel or merely allow the panel to be reduced to small portions. The cuts forming the plates can be applied to the box when it is stamped using well known standard techniques in the art.

An aspect of the invention is a device of a pizza box that incorporates plates. The pizza box includes a bottom section that includes a bottom panel having a front edge, two opposite side edges, and a rear edge, and side panels integral with and extending upwardly from each edge of the bottom panel and attached together to form an open box shape. The pizza box also includes a cover section that includes a top panel having a front edge, two opposite side edges, and a rear edge, flap panels integral with and depending downwardly from the front edge and each side edge of the top panel, and hinge means hingeably attaching the rear edge of the top panel to a top edge of the side panel extending upwardly from the rear edge of the bottom panel. The device also includes a plurality of continuous line slit cuts through panel material, the panel through which the cuts are provided being chosen from the group consisting of the bottom panel alone, the top panel alone, and both the top and bottom panels. The line slit cuts are shaped to be the periphery of a plurality of individual plate shapes removable from the panel, and are interrupted by uncut panel material of sufficient length to hold the plates in the box when it is being used to carry the pizza, but allow ready removal of the plate shape from the box panel.

It is preferred that at least one section of the line slit cuts of one side of each plate shape be asymptotic to an edge of the panel. It is further preferred that the panel with the line slit cuts be only the top panel. It is also preferred that the line slit cuts form four circular plate shapes. It is further preferred that the line slit cuts of each four circular plate shapes be asymptotic to adjacent edges of the top panel. It is also preferred that the panels with the line slit cuts are through both the top panel and the bottom panel, and the line slit cuts form eight circular plate shapes. It is further preferred that each plate shape include a peripheral edge rim bent toward a surface of the plate shape to be used as the top. It is also preferred that the peripheral edge rims are bent toward the inside of the box. It is also preferred that the top panel include a nonporous inside surface. It is further preferred that any panel not including slit cut plate shapes shall include a plurality of second line slit cuts through the panel material, and that the second line slit cuts be of sufficient length and be positioned to bisect the panel and to divide the panel into at least four proximately equal parts. Again the second line slit cuts are interrupted by uncut panel material of sufficient length to hold the parts to the box shape when it is being used to carry the pizza, but allow ready separation of the box panel into the parts for disposal. It is further preferred that the second line slit cuts extend through panel material of the side panels.

Another aspect of the invention is a device of a pizza box that incorporates plates and breaks down for disposal. The box is the same as above with the top panel of the cover section including a nonporous inside surface. The device includes four continuous first line slit cuts through panel material of the top panel, wherein the first line slit cuts are shaped to be the periphery of four circular plate shapes removable from the top panel. The first line slit cuts of each plate shape are asymptotic to adjacent edges of the top panel and are interrupted by uncut panel material of sufficient length to hold the plates in the box when it is being used to carry the pizza, but allow ready removal of the plate shape from the box panel. The device also includes rim bends of each peripheral edge of each plate shape toward the inside of the box. The device also includes a plurality of second line slit cuts through panel material of the bottom panel, wherein the second line slit cuts are of sufficient length and are positioned to bisect the bottom panel and to divide the panel into at least four proximately equal parts. The second line slit cuts are interrupted by uncut panel material of sufficient length to hold the parts to the box shape when it is being used to carry the pizza, but allow ready separation of the bottom panel into the parts for disposal.

DESCRIPTION OF PREFERRED EMBODIMENTS

Figure 1:
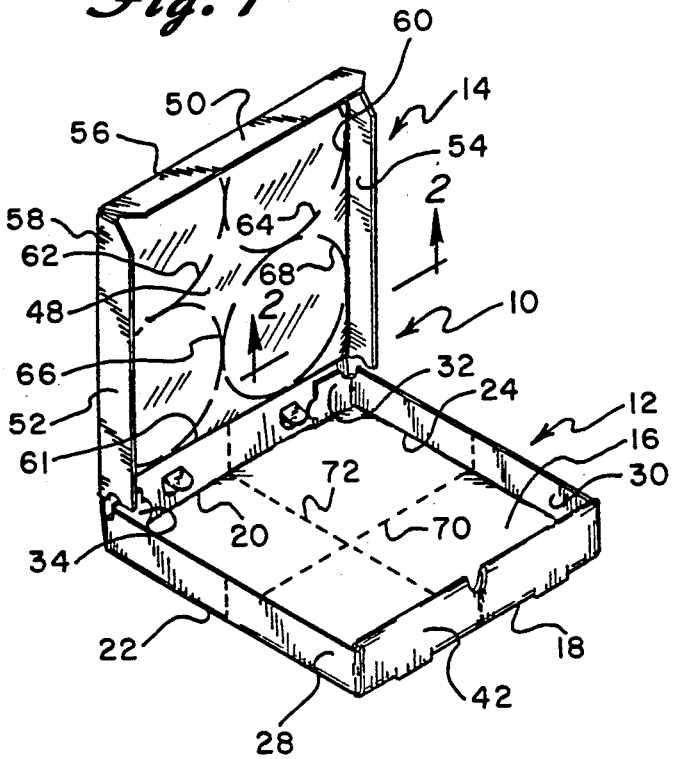
FIG. 1 is a perspective view of a box of the present invention shown folded together and open ready to receive a pizza pie.
Figure 3:
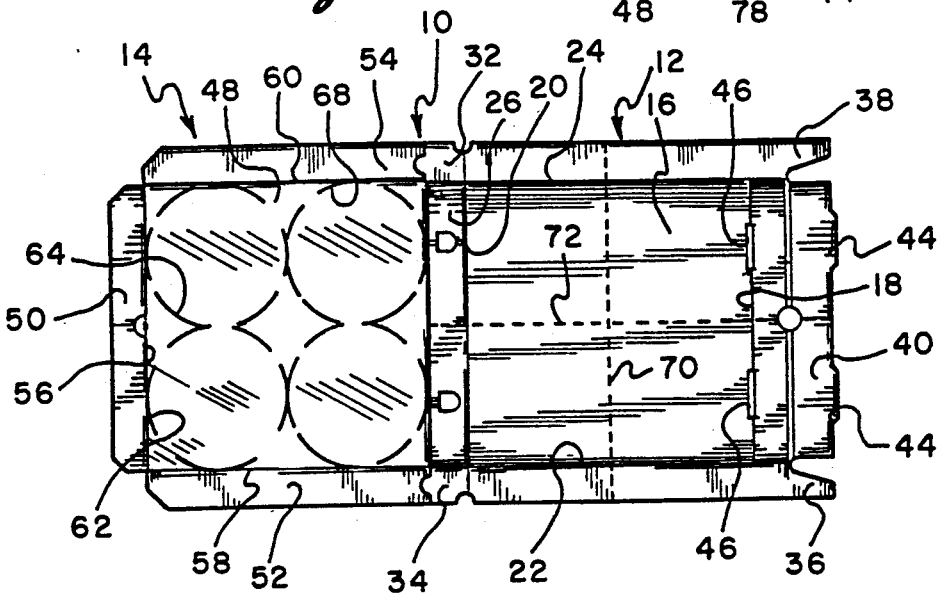
FIG. 3 is a top plan view of the pizza box illustrated in FIG. 1 flattened out to show the entire inside of the box and the manner in which the box is manufactured and supplied to the user.

Box 10 is constructed of corrugated cardboard box material using standard materials and manufacturing techniques well known in the art. Bottom section 12 is an open box shape to hold the pizza while hingeably attached cover section 14 folds downwardly to form a closed box to protect the pizza pie during delivery. Bottom section 12 includes square bottom panel 16 on which the pizza pie rests. This panel may be square, octagonal or hexagonal in shape and should be of sufficient size and shape to hold either twelve, fourteen, or sixteen inch pies. Bottom panel 16 includes front edge 18, rear edge 20, left side edge 22 and right side edge 24. From each of these edges, side panels integral with bottom panel 16 extend upwardly and are attached to form the open box shape of section 12. In forming the open box shape, rear side panel 26 is folded upwardly along edge line 20 to form the rear wall of the box shape. Left side panel 28 and right side panel 30 are folded upwardly with right rear tab 32 and left rear tab 34 folded inwardly inside of rear side panel 26. Notches in tabs 32 and 34 engage the edge of flap panels on cover section 14 to lock the box in shape as the cover section is closed. Left front tab 36 and right front tab 38 shown more clearly in FIG. 3 fold inwardly and are caught by front locking panel 40 as it is folded downwardly against front side panel 42 which is folded upwardly with tabs 36 and 38 on the inside surface. Tabs 44 extending from the outer edge of locking panel 40 engage slots 46 which are proximate front edge 18 to lock section 12 in a box shape. Cover section 14 includes top panel 48 which essentially matches in shape and size bottom panel 16. Depending downwardly toward bottom section 12 as box 10 is closed are flap panels integral with top panel 48. Front flap 50, left side flap 52 and right side flap 54 are folded downwardly and are tucked inside of each adjacent side panel of bottom section 12 when box 10 is closed. Front flap 50 is folded downwardly along front edge 56 of top panel 48. Likewise, left side flap 52 is folded downwardly along left side edge of top panel 48 and right side flap 54 is folded downwardly along right side edge of top panel 48 for form top section 14 of the box. Top panel 48 is integrally and hingeably attached along fold line 61, which is the top edge of rear side panel 26 and the rear edge of top panel 48. Schematic drawings are provided of the slit cuts through top panel 48 and bottom panel 16. Four circular plate shapes are outlined and formed by roulette cuts through top panel 48. The cuts are circular and are each asymptotic to two side edges of panel 48 as well as to the adjacent plate shapes. For example, left front circular slit cut 62 is asymptotic to front edge 56 and left side edge 58 and is about eight inches in diameter. Slit cut 62 is also asymptotic to right front slit cut 64 which is asymptotic to front edge 56 and right side edge 60. Circular cut 62 is also asymptotic to circular slit cut 66 which is asymptotic to rear top edge 61 and left side top edge 58. Finally, eight inch diameter circular slit cut 68 is asymptotic to the right side top edge 60, rear top edge 61 and circular cuts 64 and 66. The inside surface of top panel 48 is coated with an impervious coating such as polyethylene, polypropylene, paraffins, or like polymeric materials commonly used to prevent paper products from absorbing liquids such as on standard paper plates. Although FIGS. 1 and 3 are lined to show the impervious coating only applied to cover section 14, another embodiment may utilize the coating over the entire inside surface of box 10. The dimensions given above illustrate four eight inch diameter plates removed from top panel 48. If the box is sized differently, such as for fourteen or twelve inch pies, the plates removed from the top panel would have a diameter approximately one-half of the width of the top panel. If the top panel is octagonal or hexagonal in shape, four plates close to the same size can be provided and even less of the top panel would be left after the plates are removed. In the embodiment as shown, only a diamond shaped center section would remain along with the frame of the box with the three flaps which can be easily folded and discarded. In addition to the circular slit cuts forming the plates from top panel 48, cross cuts 70 and 72 bisect bottom panel 16 into four square portions. Slit cut 70 extends from left edge 22 to right side edge 24 and bisects bottom panel 16 in two equal parts. Slit cut 72 is also a straight cut extending from front bottom edge 18 to rear bottom edge 20, again bisecting the bottom panel. As shown, the slit cuts also extend upwardly cutting through each of the side panels of bottom section 12. These slit cuts allow the bottom section 14 to be torn or broken into four equal parts with minimum tearing and effort to facilitate discarding the box. If a suitable impervious coating is applied to bottom panel 16, these sections could also be used as service pieces.

Figure 2:
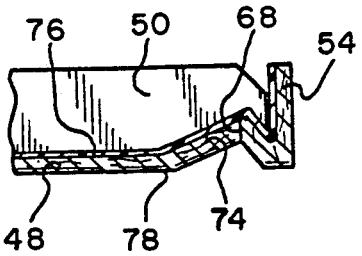
FIG. 2 is a cross-sectional view taken along lines 2—2 of FIG. 1.

Standard perforating techniques are utilized with the slit cuts being interrupted about every one-eighth to one-half inch with uncut material ranging from a few mils to about one-tenth of an inch depending upon the strength, particularly the tear strength, of the box material. The slit cuts to facilitate tearing up and discarding the bottom section of the box, without intending to utilize the parts as serving platters, may vary somewhat, particularly around the bends and up the side panels of the box bottom section. For strength and rigidity of the box during use before being discarded, it is necessary to leave substantially longer uncut material between one section of the slit cut and the next section of the slit cut along the line of cut. The cross-sectional view of FIG. 2 shows the formation of peripheral rim 74 which, when the plate is removed for use, bends upwardly to aid in handling and to more easily hold juices dropping onto the plate surface 76, it being the impervious surface on the inside of cover section 14. Peripheral rim 74 is formed by bending bottom section 48 along a circular line 78 about one-quarter to one-half inch inside the peripheral edge of the plate formed by slit cut 68. To facilitate stacking of the boxes, rim 74 is formed by depressing the cardboard inwardly into the interior of the box as close as possible to edge 60 and like edges forming return bend 80 which abuts right side flap 54. Return section 80 is as short a distance as possible in order to achieve the rim shape, preferably about one-eighth inch in length. The peripheral rim shapes of each plate shape are formed similarly to that illustrated in FIG. 2.

Figure 4:
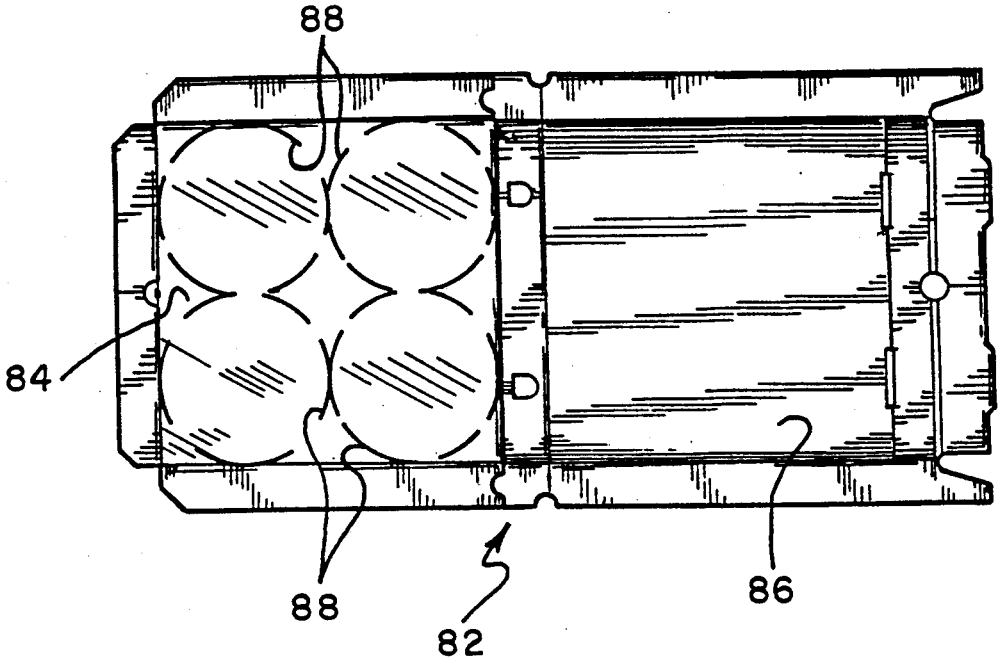
FIG. 4 is a top plan view of a second embodiment of a box of the present invention.
Figure 5:
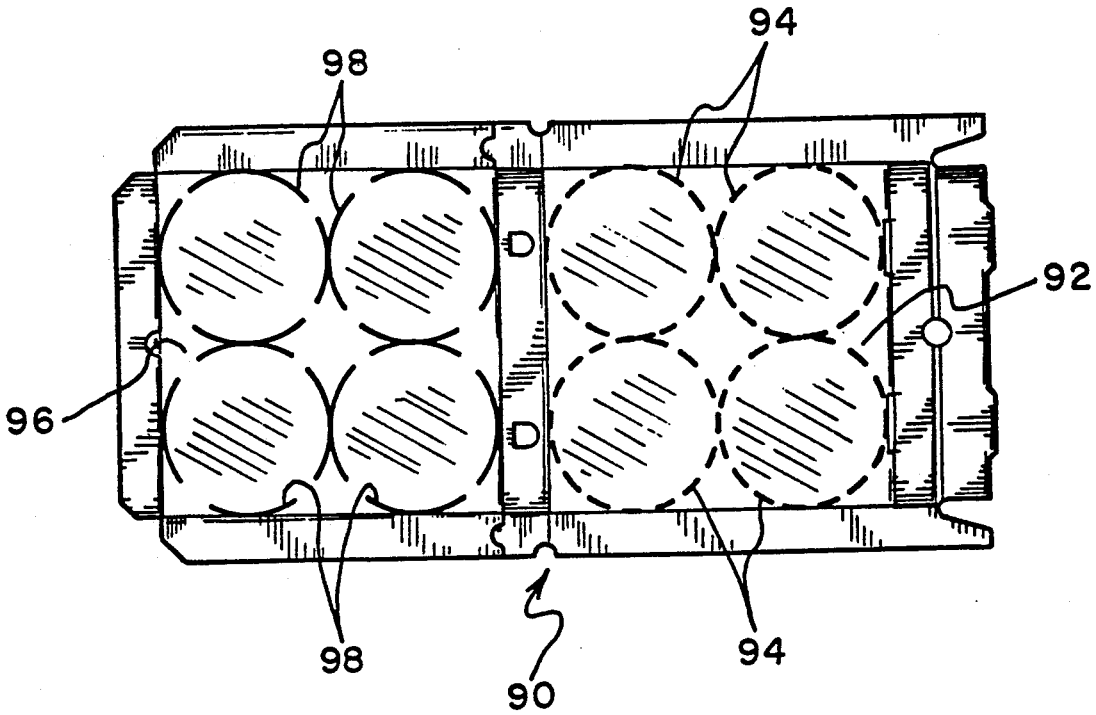
FIG. 5 is a top plan view of a third embodiment of a box of the present invention.
Figure 6:
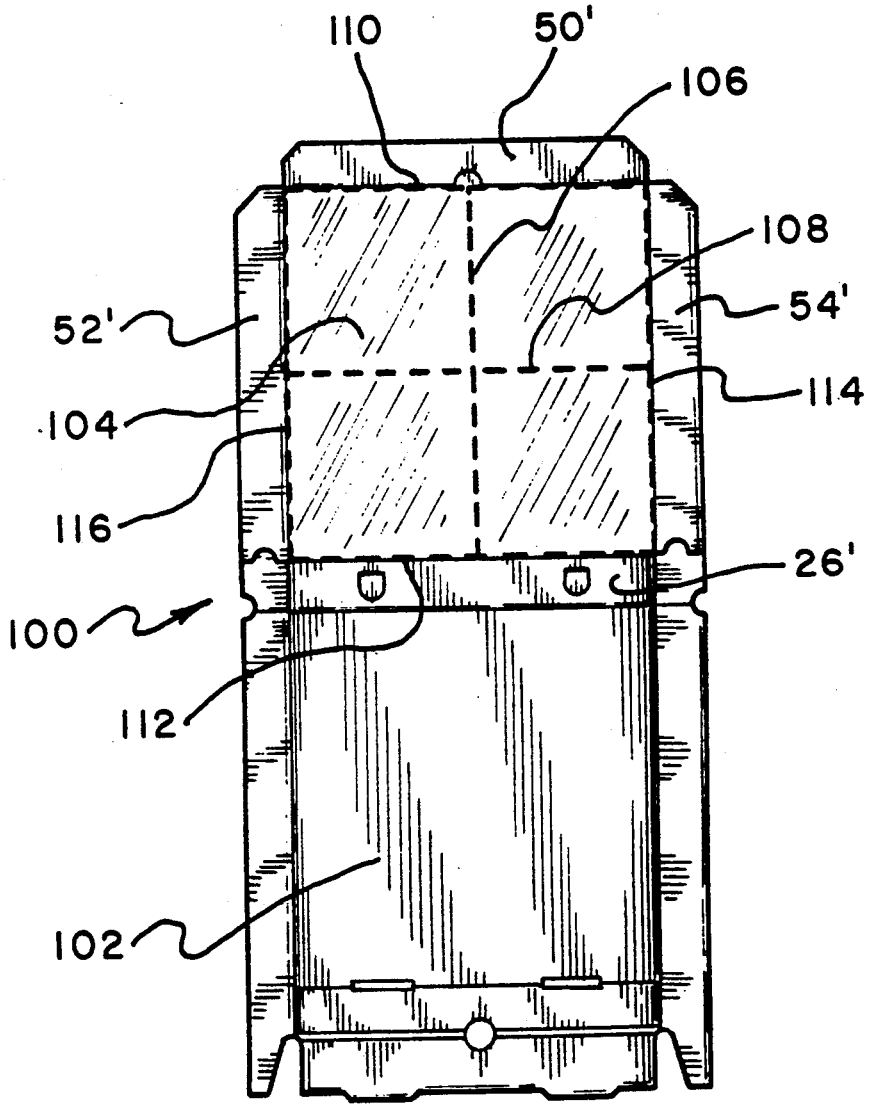
FIG. 6 is a top plan view of a fourth embodiment of a box of the present invention.

A second embodiment illustrated in FIG. 4 utilizes a box construction and shape identical in every respect to that illustrated in FIGS. 1 through 3. In this embodiment, bottom panel 86 includes no slit cuts and must be discarded in standard methods. Top panel 84 includes line slit cuts essentially identical to that shown in FIGS. 1 through 3 forming four circular plates, each having a diameter about one-half of the width and length of the top panel. A third embodiment of the invention is illustrated in FIG. 5 wherein box 90 is essentially identical to that illustrated in FIGS. 1 through 3. In this embodiment, bottom panel 92 and top panel 96 are both coated with impervious polymeric plastic coatings to protect the surface when the panels are pulled apart to form serving plates. Bottom panel 92 includes slit cuts 94 forming four circular serving plates. Top panel 96 includes slit cuts 98 forming four circular serving plates. When box 90 is used to serve pizza, the four plates are removed from top panel 96 which allows about one-half of the pizza to be removed from bottom panel 92. This exposes two of the lower plates which may be removed and additional portions of the pizza be served. In this fashion, all of the plates are uncovered and utilized to serve the pizza. Box 100 is illustrated in FIG. 6 to show another style of serving pieces that can be removed from the panels of a pizza box of the present invention. Box 100 is again essentially identical of that of box 10 of FIGS. 1 through 3. Bottom panel 102 is left whole without any slit cuts. Top panel 144 includes slit cuts to form four separate serving dishes. In this embodiment, each dish is square formed by cross slit cuts 106 and 108 which each bisect 108 in the form of a cross. Slit cuts are cut along each edge of top panel 104. Slit cut 110 extends along the edge proximate front flap 50'; slit cut 112 extends along the top edge of side panel 26'; slit cut 114 extends along the right top edge along flap 54' and slit cut 116 extends along the left top edge adjacent flap 52'. In this embodiment, square plates are formed and the entire panel 104 is utilized in forming the plates.

It will be apparent that although the above configurations are preferred to utilize as much of the panels as possible and to facilitate breakdown of the boxes, the number and shape of the serving pieces formed from the panels may vary considerably. Two oblong platters can be formed from the top panel wherein each platter edge is asymptotic to two edges of the panel and asymptotic to the adjacent platter. Three circular plates can be formed from the top panel two asymptotic to two side edges and one circular plate being asymptotic to a side edge and the other two plates. If none of the plates are asymptotic to each other or to the edges, a half inch space can be utilized between the edges of the panel and the periphery of the plates with a space between the plates. This provides a box with greater structural integrity but reduces the size of the plates somewhat. In this latter embodiment with the plates removed, it is still an easier task to crush the box for disposal.

While this invention has been described with reference to the specific embodiments disclosed herein, it is not confined to the details set forth and the patent is intended to include modifications and changes which may come within and extend from the following claims.

We claim:

1. A device of a pizza box that incorporates plates comprising:

(A) a pizza box comprising:

(i) a bottom section comprising:

(a) a bottom panel having a front edge, two opposite side edges, and a rear edge, and (b) side panels integral with and extending upwardly from each edge of the bottom panel and attached together to form an open box shape, (ii) a cover section comprising:

(a) a top panel having a front edge, two opposite side edges, and a rear edge, (b) flap panels integral with and depending downwardly from the front edge and each side edge of the top panel, and (c) hinge means hingeably attaching the rear edge of the top panel to a top edge of the side panel extending upwardly from the rear edge of the bottom panel, (B) a plurality of continuous first line slit cuts through panel material, the panel through which the first cuts are provided being chosen from the group consisting of the bottom panel alone and the top panel alone, the choice defined as the first panel and the remaining top or bottom panel being defined as the second panel, wherein the first line slit cuts are (i) shaped to be the periphery of a plurality of individual shapes each of sufficient size and shape to hold at least one slice of pizza, the shapes being removalbe from the panel, and (ii) interrupted by uncut panel material of sufficient length to hold the shapes in the box when it is being used to carry the pizza, but allow ready removal of the shapes from the box panel, and (C) a plurality of second line slit cuts through the second panel material, wherein the second line slit cuts (i) are of sufficient length and are positioned to bisect the second panel and to divide the second panel into at least four proximately equal parts, and (ii) are interrupted by uncut panel material of sufficient length to hold the parts to the box shape when it is being used to carry the pizza, but allow ready separation of the second panel into the parts for disposal.

2. The device of claim 1 wherein at least one section of the first line slit cuts of one side of each shape is asymptotic to an edge of the panel.

3. The device of claim 1 wherein the first line slit cuts form four circular shapes.

4. The device of claim 1 wherein each shape comprises an edge rim around the entire periphery of the shape, the rim being bent toward a surface of the shape.

5. The device of claim 4 wherein the edge rims are bent toward the inside of the box.

6. The device of claim 1 wherein the top panel comprises a nonporous inside surface.

7. The device of claim 1 wherein the second line slit cuts extend through panel material of the side panels.

8. A device of a pizza box that incorporates plates comprising:

(A) a pizza box comprising:

(i) a bottom section comprising:

(a) a bottom panel having a front edge, two opposite side edges, and a rear edge, and (b) side panels integral with and extending upwardly from each edge of the bottom panel and attached together to form an open box shape, (ii) a cover section comprising:

(a) a top panel having a front edge, two opposite side edges, a rear edge, and a nonporous inside surface, (b) flap panels integral with and depending downwardly from the front edge and eachh side edge of the top panel, and (c) hinge means hingeably attaching the rear edge of the top panel to a top edge of the side panel extending upwardly from the rear edge of the bottom panel, (B) a plurality of continuous first line slit cuts through panel material of the top panel, wherein the first line slit cuts (i) are shaped to be the periphery of four circular shapes each of sufficient size and shape to hold at least one slice of pizza, the shapes being removable from the top panel, (ii) of each shape are asymptotic to adjacent edges of the top panel and (ii) are interrupted by uncut panel material of sufficient length to hold the shapes in the box when it is being used to carry the pizza, but allow ready removal of the shapes from the box panel, (C) rim bends of each peripheral edge of each shape toward the inside of the box, and (D) a plurality of second line slit cuts through panel material of the bottom panel, wherein the second line slit cuts (i) are of sufficient length and are positioned to bisect the bottom panel and to divide the panel into at least four proximately equal parts, and (ii) are interrupted by uncut panel material of sufficient length to hold the parts to the box shape when it is being used to carry the pizza, but allow ready separation of the bottom panel into the parts for disposal.

9. A device of a pizza box that incorporates plates comprising:

(A) a pizza box comprising:

(i) a bottom section comprising:

(a) a bottom panel having a front edge, two opposite side edges, and a rear edge, and (b) side panels integral with and extending upwardly from each edge of the bottom panel and attached together to form an open box shape, (ii) a cover section comprising:

(a) a top panel having a front edge, two opposite side edges, and a rear edge, (b) flap panels integral with and depending downwardly from the front edge and each side edge of the top panel, and (c) hinge means hingeably attaching the rear edge of the top panel to a top edge of the side panel extending upwardly from the rear edge of the bottom panel, and (B) a plurality of continuous first line slit cuts through panel material, the panel through which the first cuts are provided being chosen from the group consisting of the bottom panel alone, the top panel alone, and both the top and bottom panels, wherein the first line slit cuts are (i) shaped to be the periphery of a plurality of individual shapes each of sufficient size and shape to hold at least one slice of pizza, the shapes being removable from the panel, and (ii) interrupted by uncut panel material of sufficient length to hold the shapes in the box when it is being used to carry the pizza, but allow ready removal of the shapes from the box panel, and wherein at least one section of the first line slit cuts of one side of each shape is asymptotic to an edge of the panel.

10. The device of claim 9 wherein the panel with the first line slit cuts is only the top panel.

11. The device of claim 9 wherein the panels with the first line slit cuts are through both the top panel and the bottom panel, and the first line slit cuts form eight circular shapes.

12. The device of claim 9 wherein the first line slit cuts are chosen from the group consisting of the bottom panel alone, and the top panel alone, and the remaining panel shall comprise a plurality of second line slit cuts through panel material, wherein the second line slit cuts (i) are of sufficient length and are positioned to bisect the remaining panel and to divide the remaining panel into at least four proximately equal parts, and (ii) are interrupted by uncut panel material of sufficient length to hold the parts to the box shape when it is being used to carry the pizza, but allow ready separation of the remaining panel into the parts for disposal.

13. The device of claim 9 wherein each shape comprises an edge rim around the entire periphery of the shape, the rim being bent toward a surface of the shape.

14. The device of claim 13 wherein the edge rims are bent toward the inside of the box.

15. A device of a pizza box that incorporates plates comprising:

(A) a pizza box comprising:

(i) a bottom section comprising (a) a bottom panel having a front edge, two opposite side edges, and a rear edge, and (b) side panels integral with and extending upwardly from each edge of the bottom panel and attached together to form an open box shape, (ii) a cover section comprising:

(a) a top panel having a front edge, two oppossite side edges, and a rear edge, (b) flap panels integral with and depending downwardly from the front edge and each side edge of the top panel, and (c) hinge means hingeably attaching the rear edge of the top panel to a top edge of the side panel extending upwardly from the rear edge of the bottom panel, and (B) a plurality of continuous first line slit cuts through panel material, the panel through which the first cuts are provided being chosen from the group consisting of the bottom panel alone, the top panel alone, and both the top and bottom panels, wherein the first line slit cuts are (i) shaped to be the periphery of a plurality of four circular individual shapes each of sufficient size and shape to hold at least one slice of pizza, the shapes being removable from the panel, and (ii) interrupted by uncut panel material of sufficient length to hold the shapes in the box when it is being used to carry the pizza, but allow ready removal of the shapes from the box panel.

16. The device of claim 15 wherein the first line slit cuts of each shape are asymptotic to adjacent edges of the top panel.

17. The device of claim 15 wherein each shape comprises an edge rim around the entire periphery of the shape, the rim being bent toward a surface of the shape.

18. The device of claim 17 wherein the edge rims are bent toward the inside of the box.

* * * * *